United States Patent [19]

Gibson et al.

[11] 3,999,734

[45] Dec. 28, 1976

[54] ADJUSTABLE DISPLAY HOLDER FOR PHOTOGRAPHS, PLAQUES AND THE LIKE

[75] Inventors: Galen G. Gibson, Edina; Russell L. Peterson, Fridley; Edward H. Rouse, St. Louis Park, all of Minn.

[73] Assignee: Gibson Holders, Inc., Minneapolis, Minn.

[22] Filed: Dec. 11, 1975

[21] Appl. No.: 639,656

[52] U.S. Cl. ..... 248/460; 211/43; 211/2

[51] Int. Cl.[2] ..... A47B 97/04

[58] Field of Search ..... 248/441 R, 448, 449, 248/451, 455, 456, 460, 461, 463, 464, 465; 211/43, 2

[56] References Cited

UNITED STATES PATENTS

| | | | |
|---|---|---|---|
| 525,186 | 8/1894 | Bowley | 211/43 |
| 1,203,659 | 11/1916 | Smith | 248/461 X |
| 2,441,655 | 5/1948 | Anderson | 248/463 |
| 2,563,671 | 8/1951 | Basinger | 248/456 |

FOREIGN PATENTS OR APPLICATIONS

| | | | |
|---|---|---|---|
| 56,599 | 6/1967 | Germany | 248/448 |

*Primary Examiner*—William H. Schultz
*Attorney, Agent, or Firm*—Merchant, Gould, Smith, Edell, Welter & Schmidt

[57] ABSTRACT

A display holder including a recessed base and one or more grooved support members. These units may be associated in four different positional relationships, and a range of distance adjustments, to give a very versatile platform or easel type of display holder.

5 Claims, 11 Drawing Figures

30
40
12
31
10
21
13
15
32
36
23
17
14
24
11
20
22

30
40
12a
30
12b
30
31
31
31
10
31
21
13
15
36
17
14
24
32
22
11
20
32
23

23
36
20
22
11
33
32
10
15
13
17
24
21
14
15
17
13
24
31
12
30
23
68°
36
20
22
35°
12
31
30

23
11
36
22
10
20
32
21
13
17
15
24
14
11
20
36
22
14
12
31
30
23
45°
27°
31
12
30

30
31
12c
32
21
13
15
22
32
14
11
17
24
20
36
23
31
31
12d
12e
30
30

ADJUSTABLE DISPLAY HOLDER FOR PHOTOGRAPHS, PLAQUES AND THE LIKE

BACKGROUND OF THE INVENTION

This invention relates to the general field of display apparatus, and more particularly to a convenient, inexpensive, adjustable holder for displaying photographs, small plates, plaques, and the like to best advantage.

Tripods and easels of various sorts are well known, and are sometimes made adjustable, to the dimensions of the article being displayed, for example.

SUMMARY OF THE INVENTION

The present invention comprises a simple, self-supporting assembly of a base member and one or more support members which can be combined to give a display unit of great flexibility, or collapsed for storage in minimum space.

Various advantages and features of novelty which characterize our invention are pointed out with particularity in the claims annexed hereto and forming a part hereof. However, for a better understanding of the invention, its advantages, and objects attained by its use, reference should be had to the drawing which forms a further part hereof, and to the accompanying descriptive matter, in which there are illustrated and described certain preferred embodiments of the invention.

DESCRIPTION OF THE PREFERRED EMBODIMENTS

Figure 1:
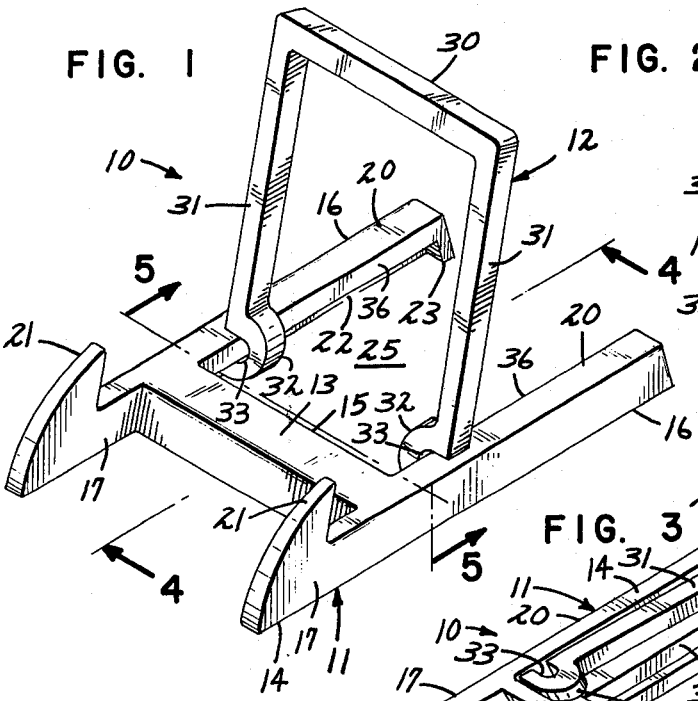
FIG. 1 is a perspective view of a display holder according to the invention.

Referring first to FIG. 1, our holder 10 is shown to comprise a base 11 and support member 12. Base 11 has an upper surface 13 and a lower surface 14: it is generally in the shape of a letter H, having a cross bar 15 extending between two lateral members 16. Each lateral member extends in two opposite directions from the cross bar, to have a first, shorter end 17 and a second, longer end 20. A projection 21 extends from the upper surface of each lateral member 16 at its shorter end.

A recess 22 is formed along the lower inner edge of the longer end of each lateral member, the recesses being terminated short of the free ends of the members as at 23. A recess 24 is formed in the lower edge of the cross bar 15 to merge with recesses 22 so as to jointly define a chamber 25 which is open between the long ends of the lateral members.

Figure 2:
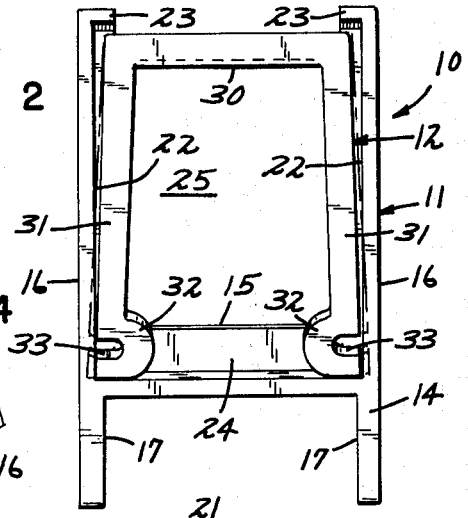
FIG. 2 shows the holder collapsed for storage.
Figure 6:
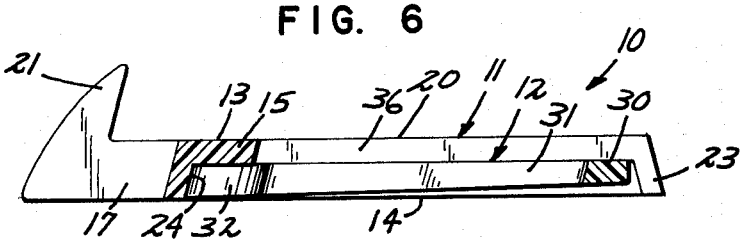
FIG. 6 is a view similar to FIG. 5 but showing the parts in their relative positions of FIG. 2.
Figure 7:
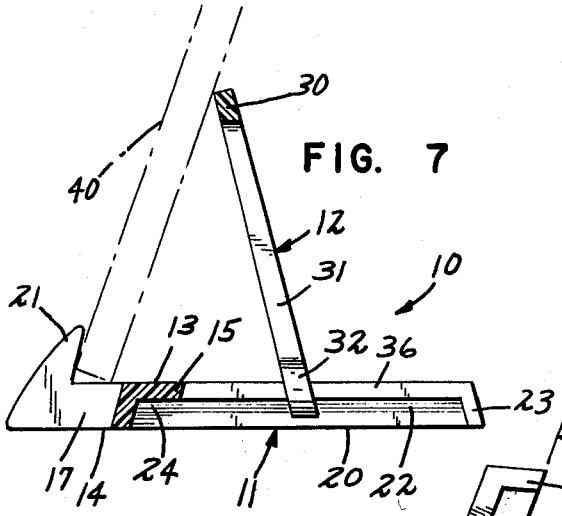
FIG. 7 is a view like FIG. 4 showing a different relation of parts.

Support member 12 is substantially flat and is generally in the shape of a letter U. It is of thickness no greater than the depth of recesses 22, and at its bight 30 is the same width as the space across base 11 between recesses 22. Member 12 is resilient and is configured so that the free ends of arms 31 spread slightly further than the length of recess 24. See the broken line showing in FIG. 2. Then by slightly compressing ends 31, member 12 may be received reversely in chamber 25. In this position, bight 30 of member 12 reinforces the longer ends of the lateral members against breaking off by inadvertently being squeezed too tightly in packaging. This is also shown in FIG. 6.

Figure 3:
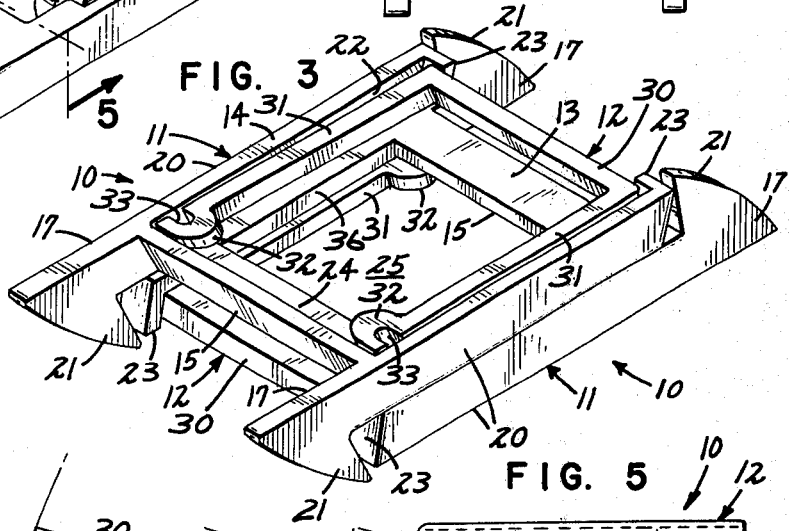
FIG. 3 shows a convenient package containing two of the holders of FIG. 1.

FIG. 3 shows how a pair of holders 10 may be positioned to occupy minimum space in packaging, and to give maximum packing protection to the holders.

Figure 4:
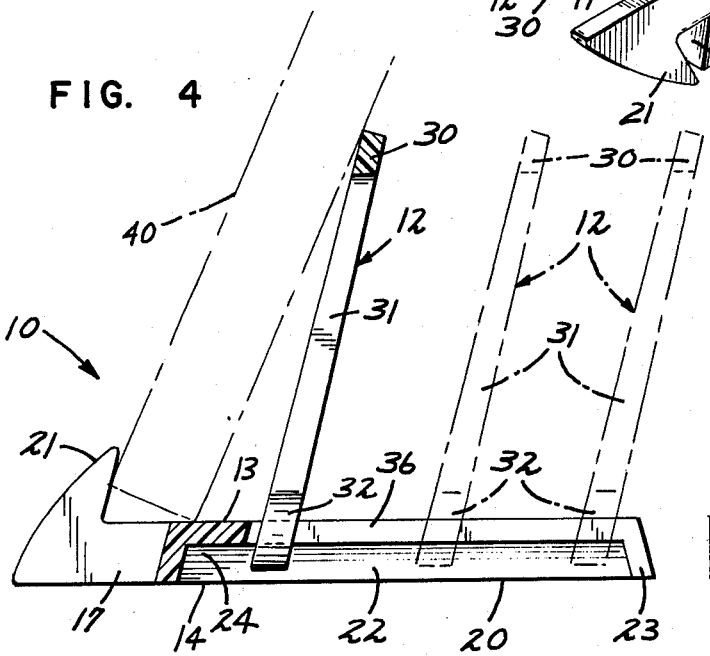
FIG. 4 is a longitudinal sectional view along the line 4—4 of FIG. 1.
Figure 5:
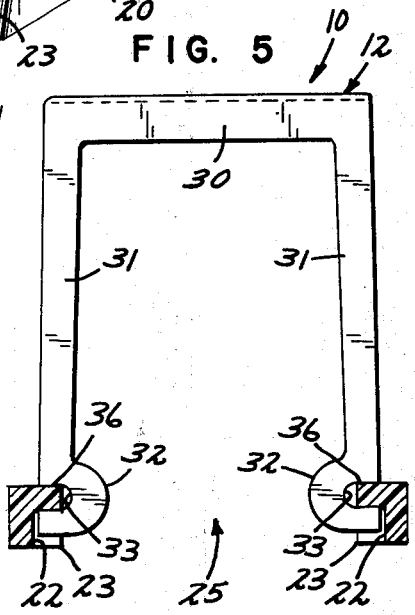
FIG. 5 is a transverse sectional view along the line 5—5 of FIG. 1.

Referring again to FIGS. 1, 4 and 5, support member 12 has a pair of bosses 32 extending inwardly at the ends of arms 31, and bosses 32 are provided with outwardly opening grooves 33. The dimensions of the grooves are chosen to receive smoothly the unrecessed portions 36 of members 20. The grooves are not perpendicular to the general plane of unit 12, but are at an oblique angle thereto: in one successful embodiment of the invention, the angle is approximately 75°.

It will now be seen that if arms 31 of member 12 are pressed together slightly, grooves 33 may be brought into alignment with portions 26 of member 16, and when released will move outward into engagement therewith. This results in an arrangement such as that shown in FIG. 4, member 12 being movable along portions 26 to any desired extent, while being maintained in its desired angulation by the angulation of grooves 33. A light object 40 may be placed on base 11 with the bottom of the object engaging projections 21, and may be supported by leaning back against the ends of members 12. In some cases, it may be desirable to insert member 12 into base 11 in the opposite sense, to slope toward projections 21 rather than away from them.

Figure 8:
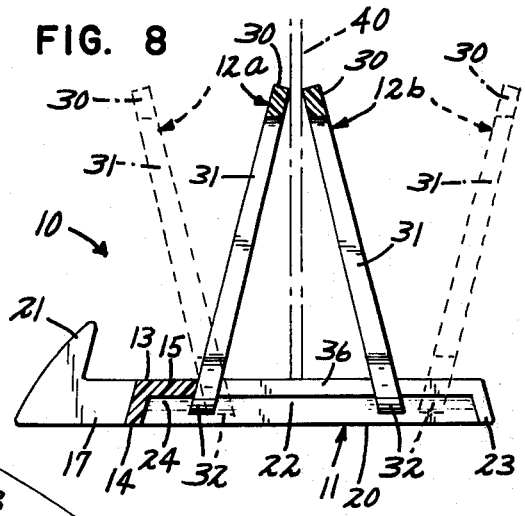
FIG. 8 is a view like FIG. 4 showing the use of plural support members.

It is also possible to use two support members 12*a* and 12*b* with a single base 11, as shown in FIG. 8. The support members may be positioned to slope toward one another or away from one another, or to be parallel if this is desired.

Figure 9:
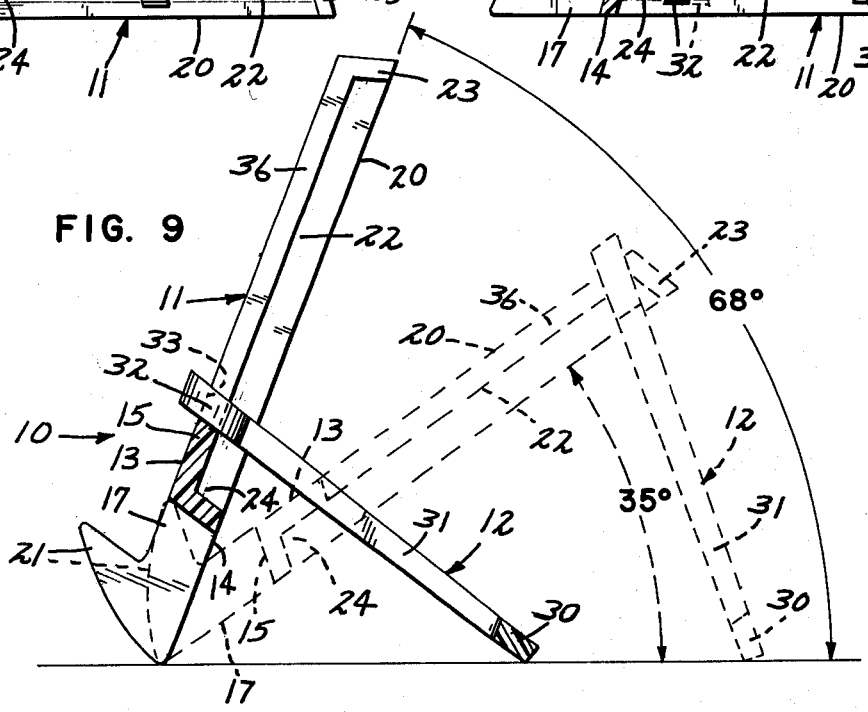
FIGS. 9 and 10 are views similar to FIG. 4 showing the range of angles available when our invention is set up as an easel.
Figure 10:
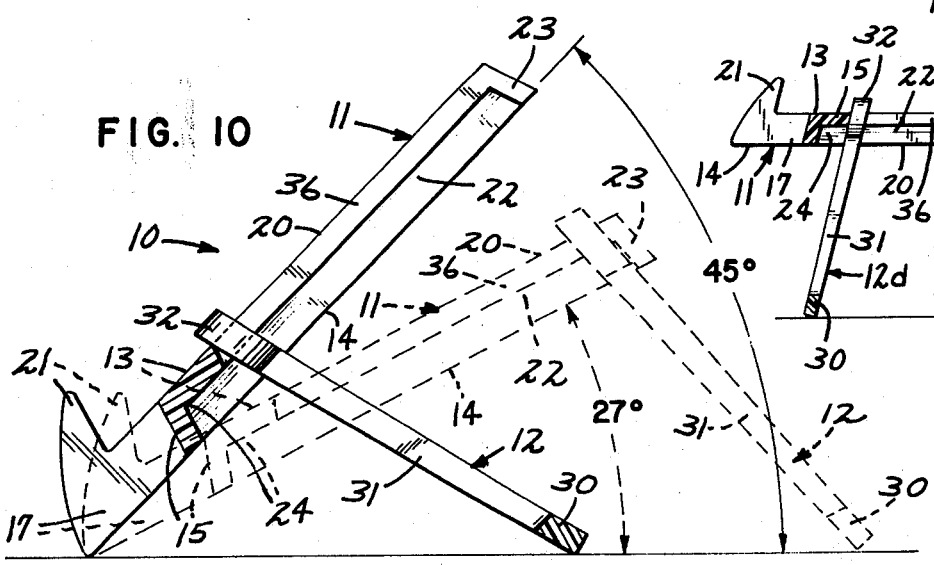

FIGS. 9 and 10 are presented to show the angular versatility of our holder when used as an easel. Here base 11 is not rested on a flat surface, but is supported on the short ends 17, and a member 12 is inserted as described above. Then, according as the member is linearly positioned with respect to the cross bar, the angle of the support may vary: in one embodiment, the variation was between 35° and 68°.

Still further, if member 12 is inserted in base 11 in projections 21 and allowed to rest back against the longer ends 20: the ends of member 12 projecting beyond base 11 are not of length to interfere with this use of the holder.

Figure 11:
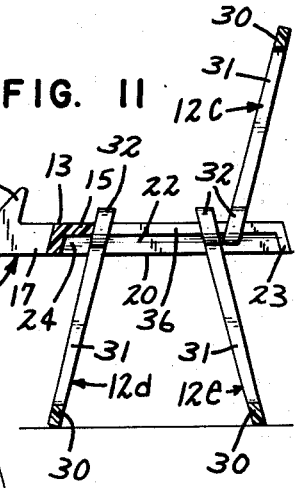
FIG. 11 is a side view, to a smaller scale, of another embodiment of the invention.

FIG. 11 shows a further embodiment of the invention. Here again base 11 does not rest on the table directly, but is supported, this time on a pair of support members 12*c* and 12*d* inserted into the base member from below in opposite orientations, while a third support member 12*e* is inserted in base 11 from above, as in FIG. 1.

It will now be apparent that there are a large number of arrangements of bases and support members which define useful and ornamental support structure, the number being increased by using plural support members and applying them to the bases from below as well as from above.

Numerous characteristics and advantages of our invention have been set forth in the foregoing description, together with details of the structure and function of the invention, and the novel features thereof are pointed out in the appended claims. The disclosure, however, is illustrative only, and changes may be made in detail, especially in matters of shape, size and arrangement of parts, within the principle of the invention, to the full extend indicated by the broad general meaning of the terms in which the appended claims are expressed.

What is claimed is:

1. In a display holder, in combination:

a base having upper and lower surfaces and comprising a generally central cross member and a pair of substantially parallel lateral members each extending in two directions from said cross member to define a plane;

projections extending out of the plane from first, shorter ends of said lateral members;

recesses of substantial depth extending along the inner edges of the other ends of said lateral members for less than their entire length, and along the cross member, to define a U-shaped open chamber;

a substantially flat, resilient, generally U-shaped support member, having a thickness substantially the same as the depth of said recess, and peripherally configured to be resiliently received reversely in said chamber;

and a pair of outwardly grooved inward bosses at the ends of the arms of said U-shaped member, the grooves therein being configured to span the unrecessed portions of said other ends of said lateral members, so that said support member is movable along said other ends of said lateral members.

2. In a display holder, in combination:

a base having upper and lower surfaces and comprising a generally central cross member and a pair of substantially parallel lateral members each extending in two different directions from said cross member to define a plane;

projections extending out of the plane from first, shorter ends of said lateral members;

recesses of substantial depth extending along the inner edges of the other ends of said lateral members for less than their entire length;

a substantially flat, resilient, generally U-shaped support member, having a thickness substantially the same as the depth of said recess;

and a pair of outwardly grooved inward bosses at the ends of the arms of said U-shaped member, the grooves therein being configured to span the unrecessed portions of said other ends of said lateral members, and extending at an oblique angle with the plane of said U-shaped member, so that said support member is movable along said other ends of said lateral members in any of four distinct positional relationships thereto.

3. Apparatus according to claim 2 in which said oblique angle is approximately 75 degrees.

4. Apparatus according to claim 1 in which the lengths of the arms of said support member are substantially the same as those of said other ends of said base.

5. The structure of claim 1 in which said base and said support member are of plastic.

* * * * *